US008093523B2

(12) United States Patent
Wang

(10) Patent No.: US 8,093,523 B2
(45) Date of Patent: Jan. 10, 2012

(54) SUPPORTING STRUCTURE, KEYSWITCH AND KEYBOARD

(75) Inventor: Yi-Chen Wang, Yongkang (TW)

(73) Assignee: Darfon Electronics Corp., Gueishan, Taoyuan (TW)

( * ) Notice: Subject to any disclaimer, the term of this patent is extended or adjusted under 35 U.S.C. 154(b) by 273 days.

(21) Appl. No.: 12/628,297

(22) Filed: Dec. 1, 2009

(65) Prior Publication Data

US 2010/0140071 A1 Jun. 10, 2010

(30) Foreign Application Priority Data

Dec. 4, 2008 (TW) ..... 97221720 U

(51) Int. Cl.
*H01H 13/70* (2006.01)

(52) U.S. Cl. ..... 200/344; 400/490

(58) Field of Classification Search ..... 200/310, 200/314, 512, 516, 313, 517, 5 A, 341, 311, 200/344; 400/490, 495, 495.1, 496, 472
See application file for complete search history.

(56) References Cited

U.S. PATENT DOCUMENTS

| | | | | |
|---|---|---|---|---|
| 6,504,121 | B2 * | 1/2003 | Hasunuma | 200/344 |
| 6,633,012 | B2 * | 10/2003 | Hsu | 200/344 |
| 6,733,196 | B2 * | 5/2004 | Lee et al. | 400/480 |
| 2001/0022915 | A1 * | 9/2001 | Hu | 400/472 |
| 2006/0000695 | A1 * | 1/2006 | Yoneyama | 200/5 A |
| 2010/0155209 | A1 * | 6/2010 | Cheng | 200/344 |

* cited by examiner

*Primary Examiner* — Edwin A. Leon
(74) *Attorney, Agent, or Firm* — Winston Hsu; Scott Margo

(57) ABSTRACT

This invention discloses a supporting structure for supporting a keycap of a switch. The supporting structure includes a first supporting member and a second supporting member. The first supporting member has a first arm, and the first arm forms a first shaft is perpendicularly protruded from the first arm. The second supporting member has a second arm including a first hook part. The first hook part forms a first containing space and a first opening connected to the first containing space. The first shaft can pass through the first opening and be rotatably contained in the first containing space by the first hook part. Accordingly, the first supporting member and the second supporting member can rotate relative to the first shaft.

15 Claims, 6 Drawing Sheets

SUPPORTING STRUCTURE, KEYSWITCH AND KEYBOARD

BACKGROUND OF THE INVENTION

1. Field of the Invention

The invention relates to a supporting structure for supporting a keycap of a keyswitch, and more particularly, the invention relates to a novel scissor-type supporting structure, keyswitch, and keyboard using the supporting structure.

2. Description of the Prior Art

A keyboard is an essential device for operating a computer. Generally, the keyboard is constituted by a plurality of keyswitches. Each keyswitch includes a base, a keycap, a supporting structure, an elastic object, and a switch. The switch is configured on the base, and the keycap is configured on the base and connected to the base through the supporting structure. The elastic object is configured between the keycap and the base, and normally above the switch.

When the keycap is pressed by a user, it moves toward the base and oppresses the elastic object to make the elastic object to trigger the switch. When the keycap is no longer pressed, the restoring force of the elastic object pushes the keycap back to the original position, and the elastic object stops triggering the switch. Besides, the supporting structure can assist the keycap to move in a predetermined range to prevent the keycap from deviating caused by pressing.

One of the popular supporting structures is the scissor-type supporting structure including two supporting members pivotally connected to each other. Please refer to FIG. 1A and FIG. 1B. FIG. 1A is a schematic diagram illustrating the supporting structure 1 in the prior art, and FIG. 1B is a schematic diagram illustrating the structure in the scope of the dotted line of the supporting structure 1 in FIG. 1A. The supporting structure 1 has two supporting member: the first supporting member 11 and the second supporting member 13. One terminal of the first supporting member 11 includes a first pivotal part 112 connected to the base of the keyswitch (not shown in the figures), and another terminal the first supporting member 11 includes two first connecting parts 114 and 115 connected to the keycap of the keyswitch (not shown in figures). One terminal of the second supporting member 13 includes two second pivotal parts 132 and 133 connected to the base of the keyswitch, and another terminal of the second supporting member 13 includes a second connecting part 134 connected to the keycap of the keyswitch.

Besides, the first supporting member 11 has a first arm 111 with a shaft 1110, and the second supporting member 13 has a second arm 131 with a hole 1310. When the supporting structure 1 is assembled, the shaft 1110 of the first arm 111 is aligned and pivotally connected to the hole 1310 of the second arm 131. Accordingly, the first supporting member 11 and the second supporting member 13 can rotate relative the shaft 1110 and the hole 1310, and then support the keycap to move perpendicularly to the base.

In the prior art, the assembling process must be done by hand, and the disassembling process must be done by hand too. Therefore, in the process of assembling or disassembling, the supporting structure is easily damaged by contrived force to raise the cost. On the other hand, the contrived force in assembling process may not put the shaft into the hole to cause that the first supporting member and the second supporting member could not rotate.

SUMMARY OF THE INVENTION

Therefore, a scope of the invention is to provide a novel supporting structure for supporting a keycap to solve the problem in the prior art.

According to an embodiment, the supporting structure of the invention includes a first supporting member and a second supporting member. The first supporting member has a first arm, and the first arm has a first shaft perpendicularly protruded from the first arm. Besides, the second supporting member has a second arm, and the second arm includes a first hook part. The first hook part forms a first containing space and a first opening connected to the first containing space. The first shaft can pass through the first opening and being rotatably contained in the first containing space by the first hook part, so that the first supporting member and the second supporting member are capable of rotating relative to the first shaft.

In practice, the second arm forms a hole corresponding to the first containing space of the first hook part, and a part of the first shaft is contained in the hole when the shaft is rotatably contained in the first containing space of the first hook part. Besides, the second arm forms a groove near the hole, and the groove is used for guiding the first shaft to pass through the first opening to be contained in the first containing space and the hole.

Another scope of the invention is to provide a keyswitch to solve the problem in the prior art.

According to an embodiment, the keyswitch includes a base, a keycap, and a supporting structure. The keycap is configured on the base, and the supporting structure is configured between the keycap and the base to supporting the keycap. The supporting structure is the same as described above.

Another scope is to provide a keyboard to solve the problem in the prior art.

According to an embodiment, the keyboard includes a base, a plurality of keycaps, and a plurality of supporting structures respectively corresponding to the plurality of keycaps. The keycaps are configured on the base, and the supporting structures are configured between the keycaps and the base to supporting the keycaps. The supporting structures are the same as described above.

The supporting member of the supporting structure of the invention has the above-mentioned hook part, so that the supporting structure is provided with the advantages of convenient and speedy assemble. Besides, according to the invention, the supporting structure is not easily damaged by contrived force in the assembling processes. Furthermore, compared to the prior art, the supporting structure of the invention could rotate more smoothly.

These and other features, aspects, and advantages of the present invention will become better understood with regard to the following description, appended claims, and accompanying drawings.

BRIEF DESCRIPTION OF THE APPENDED DRAWINGS

DETAILED DESCRIPTION OF THE INVENTION

This invention provides a supporting structure, keyswitch, and keyboard using the supporting structure. The supporting structure can support the keycap of the keyswitch, and the supporting structure can be a scissor-type supporting structure.

Figure 1A:
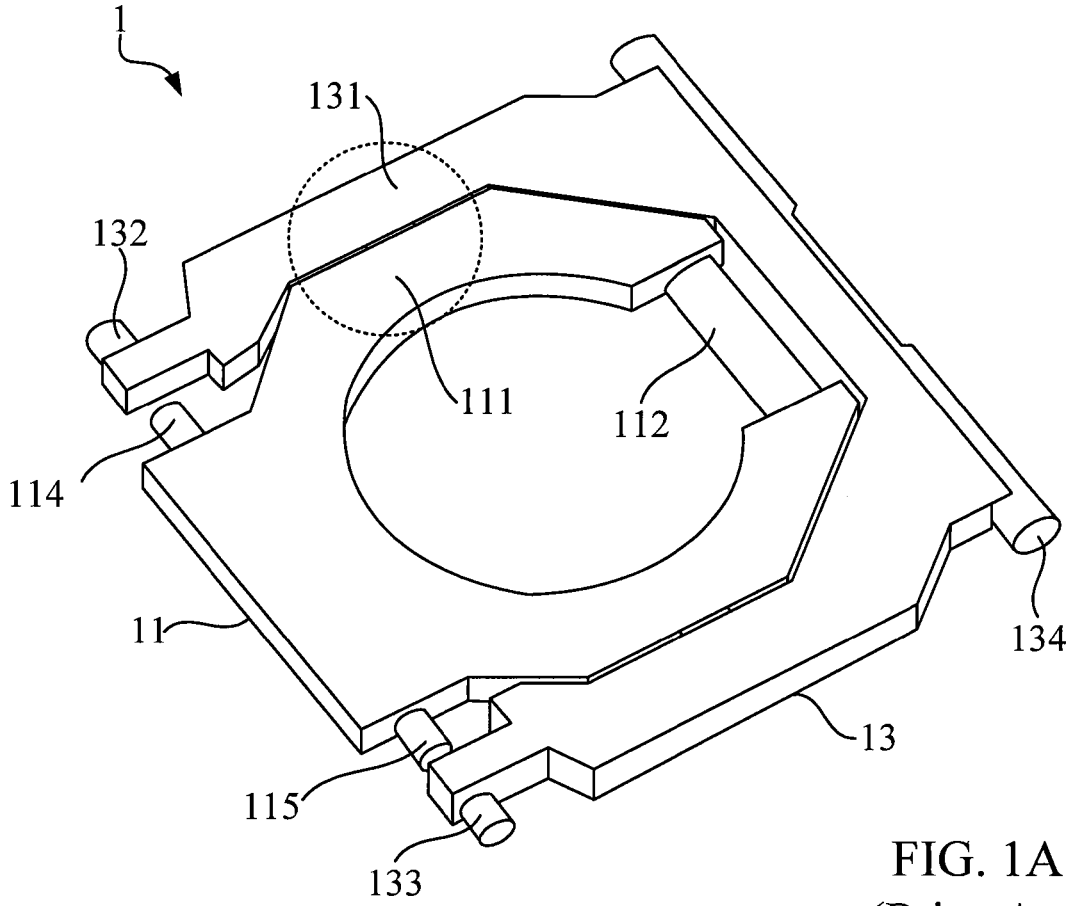
FIG. 1A (Prior Art)
FIG. 1A is a schematic diagram illustrating the supporting structure in the prior art.
Figure 1B:
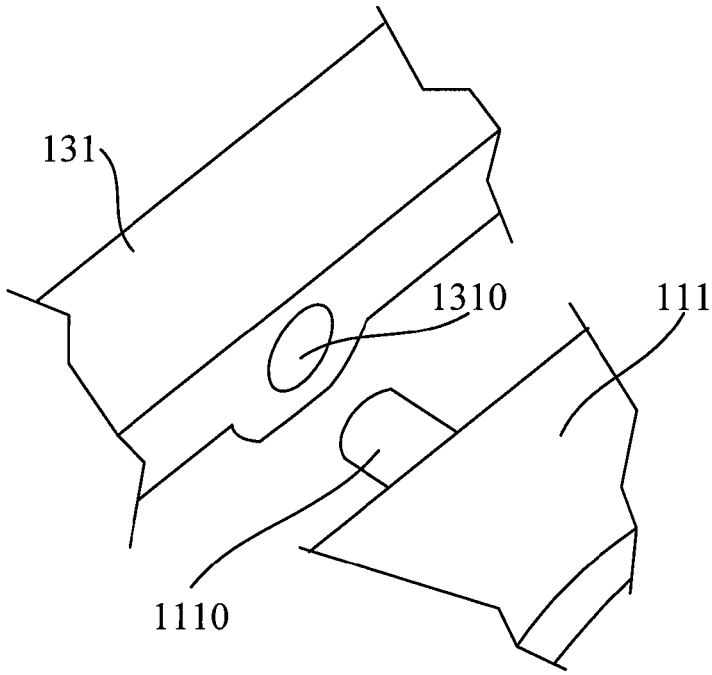
FIG. 1B (Prior Art)
FIG. 1B is a schematic diagram illustrating the structure in the scope of the dotted line of the supporting structure in FIG. 1A.
Figure 2A:
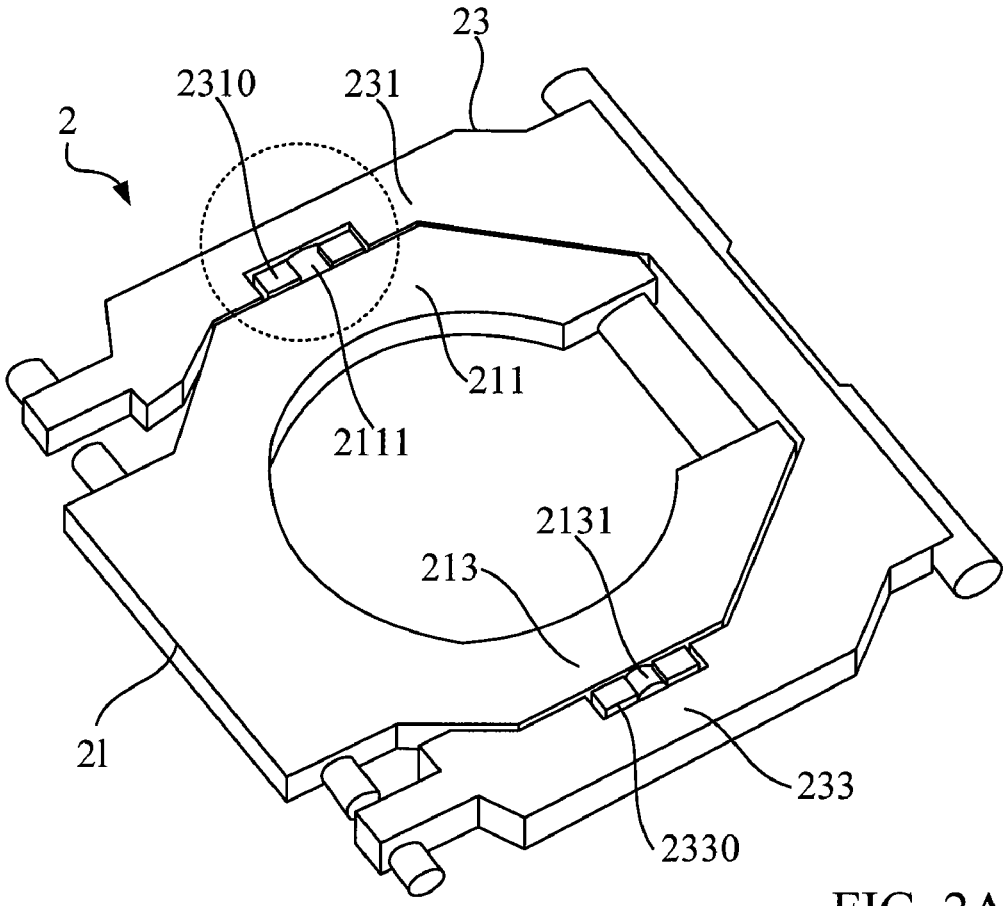
FIG. 2A is a schematic diagram illustrating the supporting structure according to an embodiment of the invention.
Figure 2B:
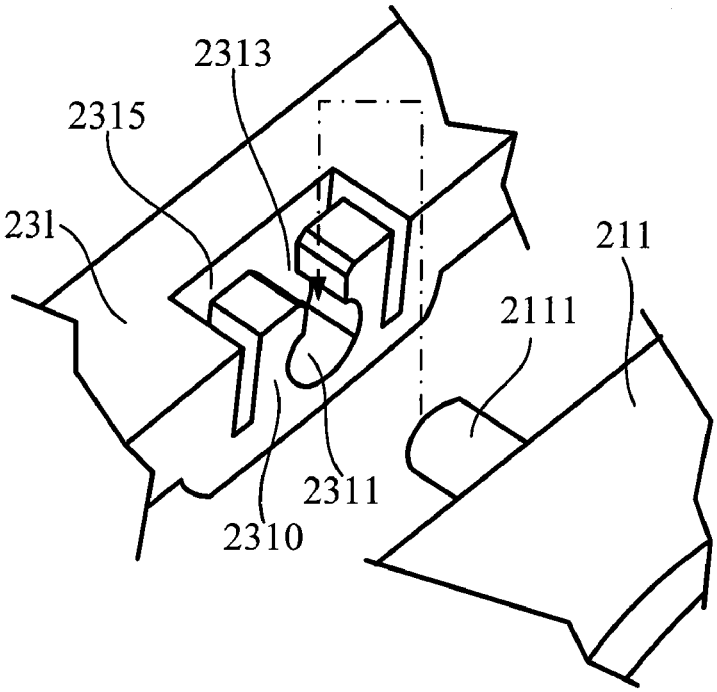
FIG. 2B is a schematic diagram illustrating the structure in the scope of the dotted line of the supporting structure in FIG. 2A.

Please refer to FIG. 2A and FIG. 2B. FIG. 2A is a schematic diagram illustrating the supporting structure 2 according to an embodiment of the invention. FIG. 2B is a schematic diagram illustrating the structure in the scope of the dotted line of the supporting structure 2 in FIG. 2A.

As shown in FIG. 2A and FIG. 2B, the supporting structure 2 includes a first supporting member 21 and a second supporting member 23. The first supporting member 21 has a first arm 211 and a third arm 213 corresponding to the first arm 211. The first arm 211 forms a first shaft 2111 perpendicularly protruded from the first arm 211, and the third arm 213 forms a second shaft 2131 perpendicularly protruded from the third arm 213.

The second supporting member 23 has a second arm 231 and a fourth arm 233 corresponding to the second arm 231. The second arm 231 includes a first hook part 2310 forming a first containing space 2311 and a first opening 2313 connected to the first containing space 2311. The fourth arm 233 includes a second hook part 2330 with the same structure as the first hook part 2310, and, in other words, the second hook part 2330 forms a second containing space (not shown in the figures) and a second opening (not shown in the figures) connected to the second containing space.

In this embodiment, the first shaft 2111 passes through the first opening 2313 and is rotatably contained in the first containing space 2311 by the first hook part 2310, so that the first supporting member 21 and the second supporting member 23 are capable of rotating relative to the first shaft 2111. Besides, the second shaft 2131 passes the second opening 2330 and is rotatably contained in the second containing space by the second hook part, so that the first supporting member 21 and the second supporting member 23 are capable of rotating relative to the second shaft 2131. In practice, the first shaft 2111 and the second shaft are located on an axis, so the first supporting member 21 and the second member 23 can rotate relative to the line connecting the first shaft 2111 and the second shaft 2131.

It should be noted that the second opening can face the same as or different direction from that of the first opening 2131 in practice. For example, if the first opening 2313 faces the first direction, the second opening can face the first direction or the second direction opposite to the first direction. Therefore, the first shaft 2111 and the second shaft 2131 can pass through the first opening 2313 and the second opening along the same direction or along different directions to be contained in the first containing space 2311 and the second containing space.

Besides, as shown in FIG. 2B, in this embodiment, the second arm 231 forms a buffering space 2315 around the first hook part 2310. The buffering space 2315 is used for buffering for the elastic deformation of the first hook part 2310 when the first shaft 2111 passes the first opening 2313. Similarly, the fourth arm 233 can form a buffering space with the same effect around the second hook part 2330.

Figure 2C:
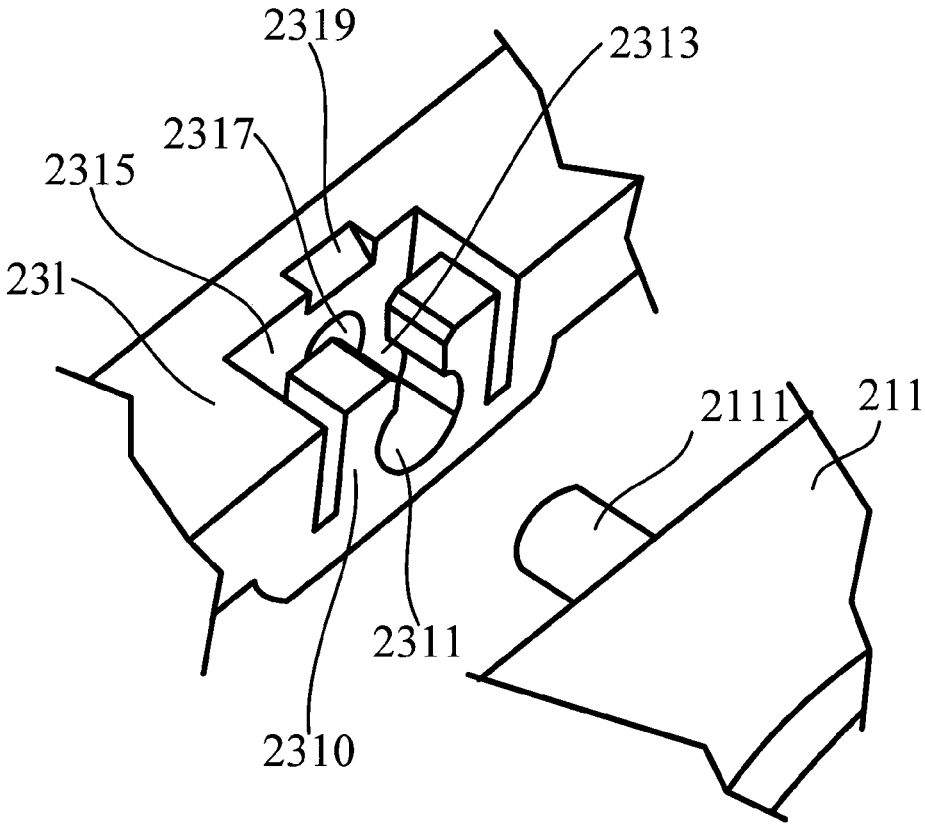
FIG. 2C is a schematic diagram illustrating another structure in the scope of the dotted line of the supporting structure in FIG. 2A according to another embodiment of the invention.

Please further refer to FIG. 2C. FIG. 2C is a schematic diagram illustrating another structure in the scope of the dotted line of the supporting structure 2 in FIG. 2A according to another embodiment of the invention. As shown in FIG. 2C, the second arm 231 of the supporting structure 2 forms a first hole 2317 corresponding to the first containing space 2311 of the first hook part 2310. Therefore, when the first shaft 2111 is rotatably contained in the first containing space 2311 of the first hook part 2310, a part of the first shaft 2111 is contained in the first hole 2317. In practice, the fourth arm 233 of the supporting structure 2 can form a second hole corresponding to the second containing space of the second hook part 2330. Therefore, when the second shaft 2131 is rotatably contained in the second containing space of the second hook part 2330, a part of the second shaft 2131 is contained in the second hole. Accordingly, the first supporting member 21 can be pivotally connected to the second supporting member 23 more strongly to prevent the first shaft 2111 from dropping from the first containing space 2311 or to prevent the second shaft 2131 from dropping from the second containing space.

Besides, as shown in FIG. 2C, the second arm 231 can further form a first groove 2319 near the first hole 2317. The first groove 2319 can guide the first shaft 2111 to pass through the first opening 2313 to be contained in the first containing space 2311 and the first hole 2317. Similarly, the fourth arm 233 of the supporting structure 2 of the invention can further form a second groove near the second hole in practice. The second groove can guide the second shaft 2131 to pass through the second opening to be contained in the second containing space and the second hole. Through the configuration of the first groove 2319 and the second groove, the supporting structure 2 of the invention could be assembled easily.

Figure 3A:
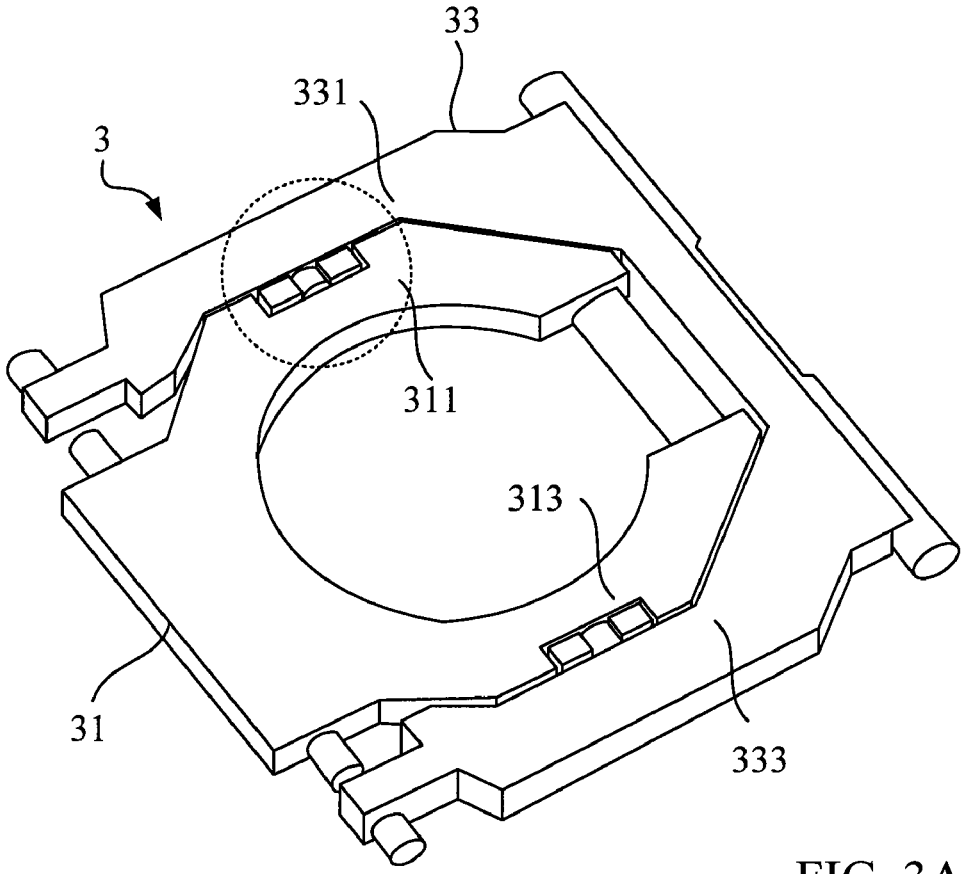
FIG. 3A is a schematic diagram illustrating the supporting structure according to an embodiment of the invention.
Figure 3B:
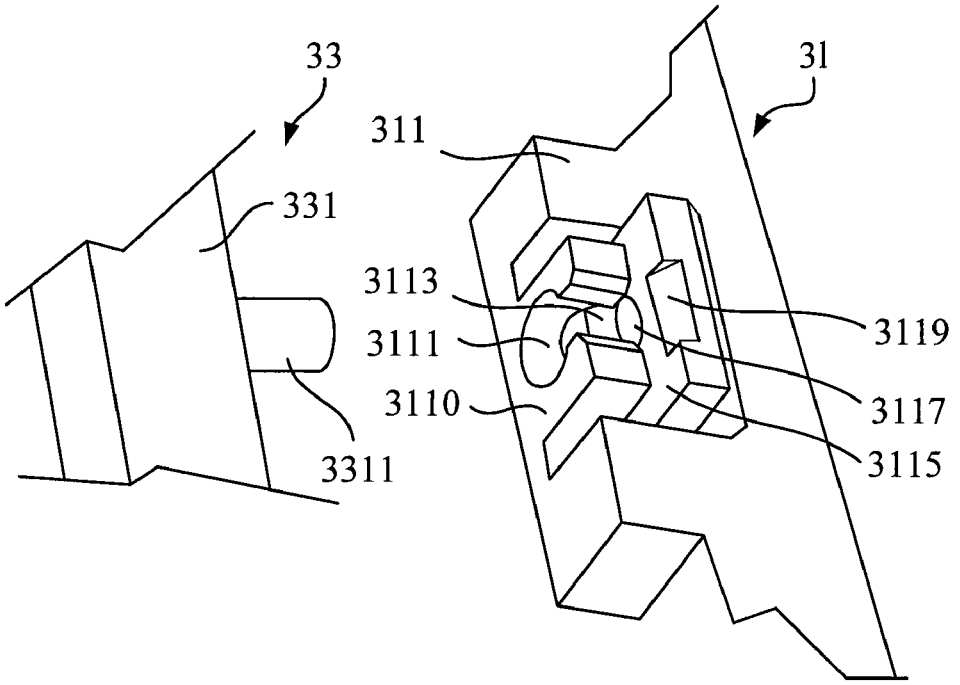
FIG. 3B is a schematic diagram illustrating the structure in the scope of the dotted line of the supporting structure in FIG. 3A.

Please refer to FIG. 3A and FIG. 3B. FIG. 3A is a schematic diagram illustrating the supporting structure 3 according to an embodiment of the invention. FIG. 3B is a schematic diagram illustrating the structure in the scope of the dotted line of the supporting structure 3 in FIG. 3A. As shown in figures, the supporting structure 3 includes a first supporting member 31 and the second supporting member 33. The first supporting member 31 has a first arm 311 and a third arm 313 corresponding to the first arm 311, and the second supporting member 33 has a second arm 331 corresponding to the first arm 311 and a fourth arm 333 corresponding to the third arm 313.

The difference from the supporting structure 2 in FIG. 2A to FIG. 2C is that the first arm 311 of the first supporting member 31 of the supporting structure 3 in this embodiment includes a first hook part 3110. As described above, the first hook part 3110 forms a first containing space 3111 and a first opening 3113 connected to the first containing space 3111, and further forms a buffering space 3115 around the first hook part 3110, a first hole 3117 corresponding to the first opening 3113, and a first groove 3119 near the first hole 3117. The first groove 3119 can guide the first shaft 3311 located on the second arm 331 to pass through the first opening 3113 to be contained in the first containing space 3111 and the first hole 3117. Similarly, the third arm 313 of the first supporting member 31 can include a hook part, a hole, and a groove to achieve the same effect as the first arm 311.

Figure 4:
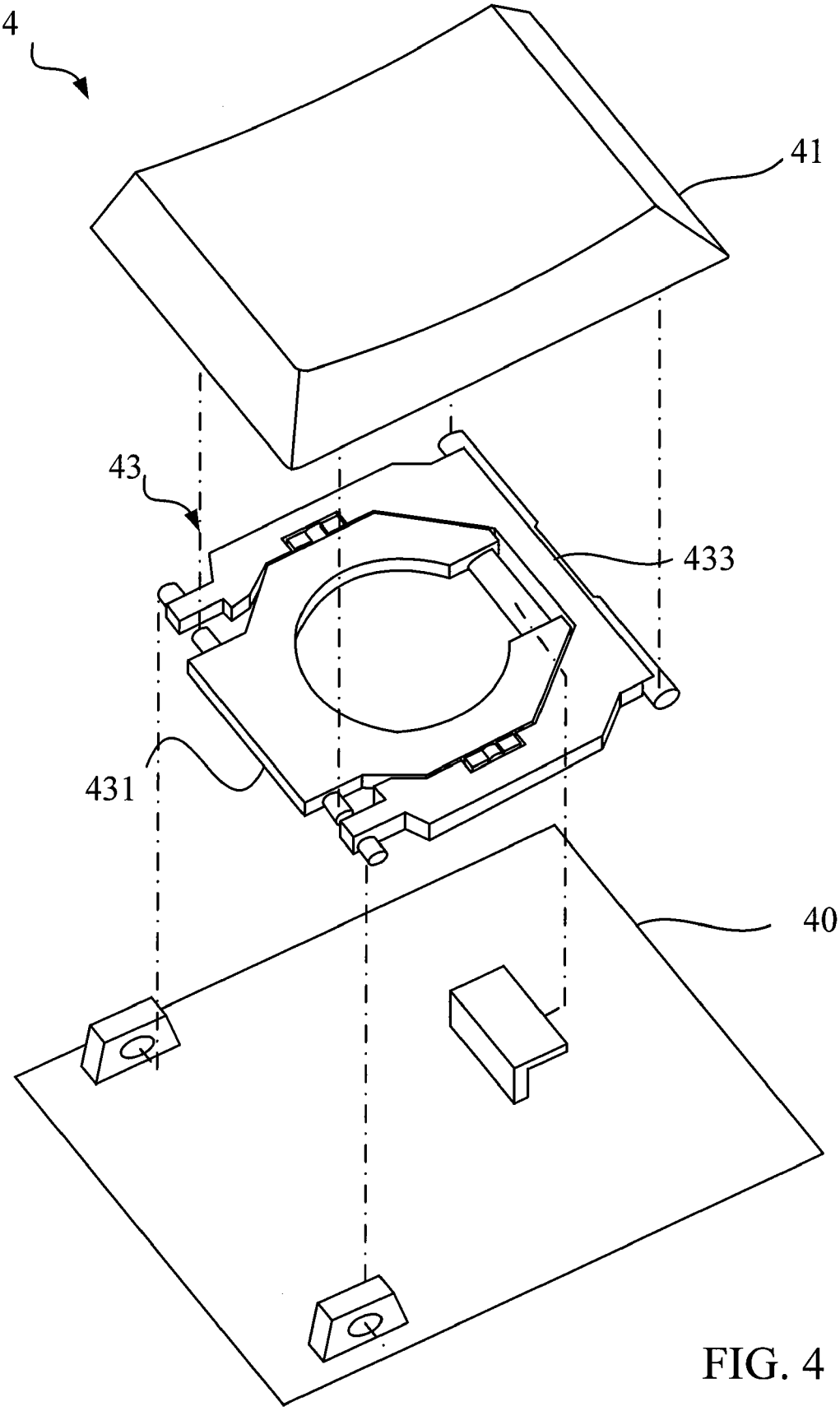
FIG. 4 is a schematic diagram illustrating the keyswitch according to an embodiment of invention.

The invention further provides a keyswitch including the above-mentioned supporting structure. Please refer to FIG. 4. FIG. 4 is a schematic diagram illustrating the keyswitch 4 according to an embodiment of invention. As shown in FIG. 4, the keyswitch 4 includes a base 40, a keycap 41, and a supporting structure 43. The keycap 41 is configured on the base 40, and the supporting structure 43 is configured between the keycap 41 and the base 40 to support the keycap 41. As described above, the supporting structure 43 includes a first supporting member 431 and a second supporting member 433. The structures and effects of the first supporting member 431 and the second supporting member 433 are described in the above paragraph, and it would not be described in detail here.

Figure 5:
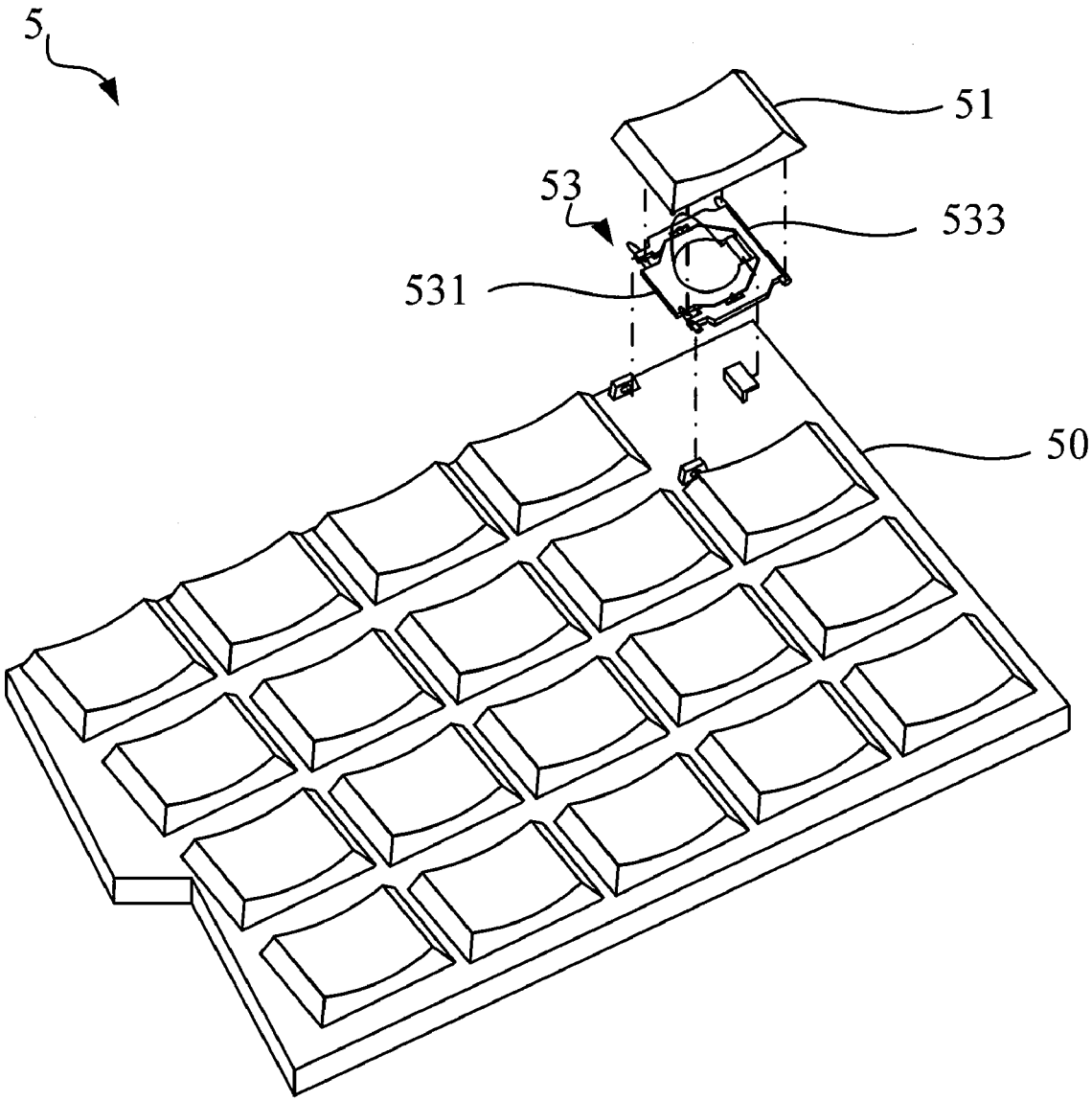
FIG. 5 is a schematic diagram illustrating the keyboard according to an embodiment of the invention.

Besides, the invention further provides a keyboard including the above-mentioned supporting structure. Please refer to FIG. 5. FIG. 5 is a schematic diagram illustrating the keyboard 5 according to an embodiment of the invention. As shown in FIG. 5, the keyboard 5 includes a base 50, a plurality of keycaps 51, and a plurality of supporting structures 53. Each keycap 51 is configured on the base 50, and each supporting structure 53 is configured between each keycap 51 and the base 50 to support each keycap 51. As described above, the supporting structure 53 includes a first supporting member 531 and the second supporting member 533. The structures and effects of the first supporting member 531 and the second supporting member 533 are described in the above paragraph, and it would not be described in detail here.

To summarize, the invention is to provide a novel supporting structure for supporting a keycap of a keyswitch. A plurality of the supporting structure of the invention can be used for supporting a plurality of keycaps on a base to form a keyboard. The supporting structure is provided with the advantages of convenient and speedy assemble. Besides, according to the invention, the supporting structure is not easily damaged by contrived force in the assembling processes. Furthermore, compared to the prior art, the supporting structure of the invention could rotate more smoothly.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A supporting structure for supporting keycap, the supporting structure comprising:

a first supporting member, having a first arm, the first arm forming a first shaft perpendicularly protruded from the first arm; and a second supporting member, having a second arm, the second arm comprising a first hook part forming a first containing space and a first opening connected to the first containing space;

wherein the first shaft is capable of passing through the first opening and being rotatably contained in the first containing space by the first hook part, so that the first supporting member and the second supporting member are capable of rotating relative to the first shaft.

2. The supporting structure according to claim 1, wherein the second arm forms a hole corresponding to the first containing space of the first hook part, and a part of the first shaft is contained in the hole when the first shaft is rotatably contained in the first containing space of the first hook part.

3. The supporting structure according to claim 2, wherein the second arm forms a groove near the hole, and the groove is used for guiding the first shaft to pass through the first opening to be contained in the first containing space and the hole.

4. The supporting structure according to claim 1, wherein the second arm forms a buffering space around the first hook part.

5. The supporting structure according to claim 1, wherein the first supporting member further comprises a third arm corresponding to the first arm, and the third arm forms a second shaft perpendicularly protruded from the third arm, the second supporting member further comprises a fourth arm corresponding to the second arm, and the fourth arm forms a second hook part, the second hook part forms a second containing space and a second opening connected to the second containing space; wherein the second shaft is capable of passing through the second opening and being rotatably contained in the second containing space by the second hook part, so that the first supporting member and the second supporting member are capable of rotating relative to the second shaft.

6. A keyswitch, comprising:

a base;

a keycap, configured on the base; and a supporting structure, configured between the keycap and the base to support the keycap, the supporting structure comprising:

a first supporting member, having a first arm, the first arm forming a first shaft perpendicularly protruded from the first arm; and a second supporting member, having a second arm, the second arm comprising a first hook part forming a first containing space and a first opening connected to the first containing space;

wherein the first shaft is capable of passing through the first opening and being rotatably contained in the first containing space by the first hook part, so that the first supporting member and the second supporting member are capable of rotating relative to the first shaft.

7. The keyswitch according to claim 6, wherein the second arm forms a hole corresponding to the first containing space of the first hook part, and a part of the first shaft is contained in the hole when the first shaft is rotatably contained in the first containing space of the first hook part.

8. The keyswitch according to claim 7, wherein the second arm forms a groove near the hole, and the groove is used for guiding the first shaft to pass through the first opening to be contained in the first containing space and the hole.

9. The keyswitch according to claim 6, wherein the second arm forms a buffering space around the first hook part.

10. The keyswitch according to claim 6, wherein the first supporting member further comprises a third arm corresponding to the first arm, and the third arm forms a second shaft perpendicularly protruded from the third arm, the second supporting member further comprises a fourth arm corresponding to the second arm, and the fourth arm forms a second hook part, the second hook part forms a second containing space and a second opening connected to the second containing space; wherein the second shaft is capable of passing through the second opening and being rotatably contained in the second containing space by the second hook part, so that the first supporting member and the second supporting member are capable of rotating relative to the second shaft.

11. A keyboard, comprising:

a base;

a plurality of keycaps, configured on the base; and a plurality supporting structures, configured between the keycaps and the base to respectively support the keycaps, the supporting structures respectively comprising:

a first supporting member, having a first arm, the first arm forming a first shaft perpendicularly protruded from the first arm; and a second supporting member, having a second arm, the second arm comprising a first hook part forming a first containing space and a first opening connected to the first containing space;

wherein the first shaft is capable of passing through the first opening and being rotatably contained in the first containing space by the first hook part, so that the first supporting member and the second supporting member are capable of rotating relative to the first shaft.

12. The keyboard according to claim 11, wherein the second arm forms a hole corresponding to the first containing space of the first hook part, and a part of the first shaft is contained in the hole when the first shaft is rotatably contained in the first containing space of the first hook part.

13. The keyboard according to claim 12, wherein the second arm forms a groove near the hole, and the groove is used for guiding the first shaft to pass through the first opening to be contained in the first containing space and the hole.

14. The keyboard according to claim 11, wherein the second arm forms a buffering space around the first hook part.

15. The keyboard according to claim 11, wherein the first supporting member further comprises a third arm corresponding to the first arm, and the third arm forms a second shaft perpendicularly protruded from the third arm, the second supporting member further comprises a fourth arm corresponding to the second arm, and the fourth arm forms a second hook part, the second hook part forms a second containing space and a second opening connected to the second containing space; wherein the second shaft is capable of passing through the second opening and being rotatably contained in the second containing space by the second hook part, so that the first supporting member and the second supporting member are capable of rotating relative to the second shaft.

* * * * *